US005312280A

United States Patent [19]

Kloba et al.

[11] Patent Number: 5,312,280

[45] Date of Patent: May 17, 1994

[54] CAROUSEL-BORNE CRT PARTICLE-PURGING SYSTEM

[75] Inventors: Anthony A. Kloba, Lombard; Gerald T. Syster, West Chicago, both of Ill.

[73] Assignee: Zenith Electronics Corporation, Glenview, Ill.

[21] Appl. No.: 44,313

[22] Filed: Apr. 7, 1993

[51] Int. Cl.[5] ..... H01J 9/20

[52] U.S. Cl. ..... 445/59

[58] Field of Search ..... 445/2, 52, 59

[56] References Cited

U.S. PATENT DOCUMENTS 3,712,699 1/1973 Syster ..... 445/59
4,398,897 8/1983 Nubani et al. ..... 445/6 X
4,416,642 11/1983 Van Ormer ..... 445/58 X
4,605,379 8/1986 Shahan ..... 445/59

FOREIGN PATENT DOCUMENTS 37845 2/1987 Japan ..... 445/59

*Primary Examiner*—Kenneth J. Ramsey

[57] ABSTRACT

A carousel-borne CRT particle-purging system dislodges particles from within the envelope of a CRT carried on a conveyer. The system includes a vibrator for imparting vibration to the envelope, and means for releasably attaching the vibrator to the envelope. The vibrator traverses on the conveyor in operative conjunction with the envelope. The system also includes a canister installed over the neck for purging the envelope with air and catching particles that fall out of the neck.

15 Claims, 3 Drawing Sheets

CAROUSEL-BORNE CRT PARTICLE-PURGING SYSTEM

FIELD OF THE INVENTION

This invention relates to the manufacture of cathode ray picture tubes, and is addressed particularly to an improved system for purging particulate matter from within the envelope of such tubes.

Particulate matter is inevitably generated within the envelope of a cathode ray tube ("CRT") during its manufacture. The particles may consist of fragments of the conductive coating on the inner surface of the funnel, clumps of phosphor cast off during the printing of the screen, glass detritus resulting from the process of sealing the funnel of the CRT to the faceplate, and metal particles shed from the shadow mask and its supports. Also, airborne particles may enter the CRT envelope during assembly. The size of the particles may range from a few microns to those visible to the naked eye.

Most of the particles respond to the pull of gravity and fall harmlessly to the lowest point in the CRT envelope. Others may become electrically charged and circulate within the envelope in response to potentials of opposite polarity. For example, particles carrying a positive charge may bombard the cathodes; those with a negative charge may bombard the positively-charged portions of the CRT such as the final anode and the shadow mask. In addition, particles may pile up on the conductive material in the neck of the CRT adjacent to the electron gun and initiate a destructive arc-over or electrical leakage path between the electrodes of the gun and the neck. Particles that find their way into the gun structure can cause arcing between the gun electrodes. Also, particles may lodge in the apertures of the shadow mask.

In brief, unless particles within the envelope are removed, the probability is high that the CRT will fail early in its service life.

DISCUSSION OF RELATED ART

It is well-known in the art of manufacture to suspend in-process articles, especially heavy, cumbersome ones such as CRTs, from a cradle attached to a moving conveyer chain which carries the articles between work stations. A work station may comprise a place where the CRTs are removed from the conveyor, and reinstalled after a process such as as the application of a conductive coating inside the CRT funnel. A work station may also comprise a loop in the conveyor system where one or more special operations are conducted while the CRTs remain on the conveyor.

A typical work station comprising a loop 10 in a conveyor system is depicted diagrammatically in FIG. 1. The loop 10 comprises a wheel-like carousel 12 which includes a large sprocket 14 attached to the underside of the carousel 12 at its perimeter. The carousel 12 is suspended by and rotates on trolleys (not shown) at the perimeter of the carousel 12. A concentric shaft 15 serves as an axle for the carousel 12. The sprocket 14, and hence the carousel 12, is caused to rotate in the clockwise direction indicated by the arrow 16 by the engagement of the teeth of the sprocket 14 with the rollers of a moving roller chain 18 and which is powered by an electric motor (not shown). The diameter of the carousel 12 is about fourteen feet, by way of example. The roller chain 18 is an endless chain whose entire length may be measured in hundreds of feet as it carries the CRTs through numerous work stations. The direction of its movement is indicated by arrow 28.

As indicated in FIG. 2, an in-process CRT 22 is suspended neck-side-down in a cradle 24 which in turn is attached to the roller chain 18 by arms 26. The CRT 22 is mounted in the cradle 24 at remote conveyor loading station (not shown), and remains on the conveyor unless it is removed for a particular operation. When all the processing has been completed, the CRT 22 is removed from the cradle 24 at a conveyor unloading station, which may also be remote from the carousel 12.

It is known in the art to remove an in-process CRT from a conveyer and install it in a fixed mount for subjection to ultrasonic vibration for particle dislodgment. It was believed that such vibration is effective only when the CRT is firmly clamped. Further, there existed no feasible means for bringing a vibrator into contact with the envelope of a conveyor-borne CRT.

An example of a CRT installed in a fixed mount is disclosed in U.S. Pat. No. 3,712,699, of common ownership herewith. The purpose according to the '699 disclosure is the removal of charged particles that electrostatically adhere to conductive elements in the CRT envelope such as the final anode, the internal magnetic shield, and the shadow mask, all of which are electrically interconnected. A high-voltage alternating current is connected to the final anode by way of the anode button. The difference in potential between the charged particles and the conductive elements loosens the particles. Concurrently, an ionized gas is circulated under pressure within the CRT envelope to electrically discharge, suspend, and exhaust the particles from the envelope.

A fixed-mount system for purging particles from a CRT by vibration or electrostatic discharge is limited in utility. The CRT must be removed from the conveyor, installed in the fixed mount, purged, removed from the mount, and returned to the conveyor—a process involving many manual operations. As a result, it is impractical to purge more than a fraction of the number of CRTs passing by on a fast-moving conveyor.

The present invention obviates the limitations of the fixed mount system in that all the CRTs carried by the conveyor can be purged of particles without removing them from the conveyor, and with no handling of the CRTs.

OBJECTS OF THE INVENTION

It is among the objects of the invention to:

a) facilitate the manufacture of CRTs;

b) prevent the failure of CRTs due to the damage that can be inflicted by particulate matter;

c) facilitate CRT manufacture by the purging of particles from all the CRTs carried on a conveyor;

d) purge the CRTs without having to remove them from the conveyor; and e) facilitate analysis of particles.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale)

in the several figures of which like reference numerals identify like elements, and in which.

DESCRIPTION OF THE PREFERRED EMBODIMENT

The conveyer-borne particle-purging system according to the invention comprises a vibrator for imparting vibration to a CRT envelope for dislodging particles from inside the envelope, means for traversing the vibratory means along with a conveyor and in conjunction with the envelope, and releasable attachment means for releasably attaching the vibratory means in operative position to the CRT envelope while the CRT is traversing the conveyor. The conveyor-borne particle-purging system also includes a canister installed over the neck of the CRT as a channel for the injection of a particle-purging gas into the CRT envelope, and for catching dislodged particles for analysis.

Figure 3:
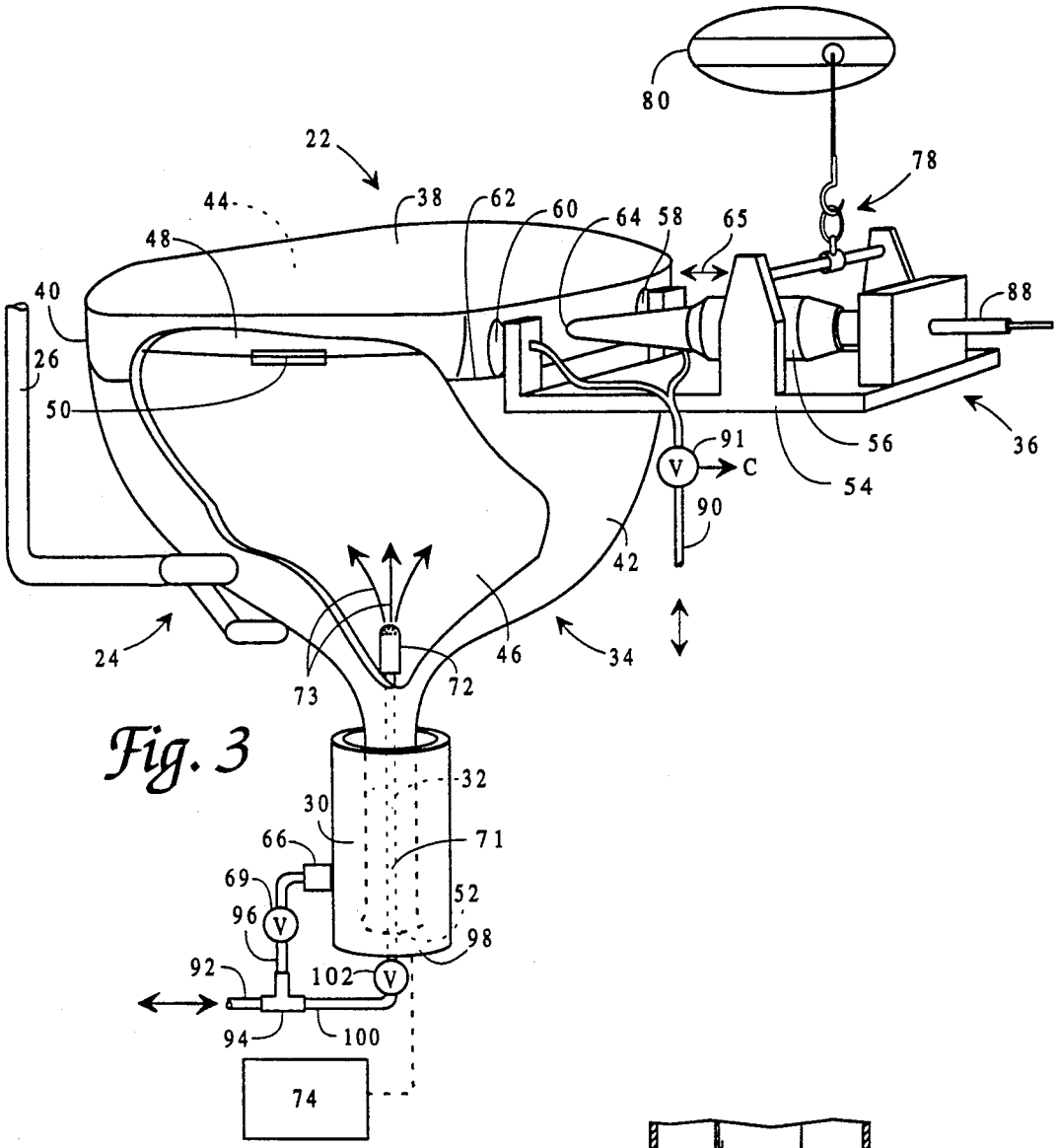
FIG. 3 is a perspective view of the CRT of FIG. 2 with a cutaway section that reveals internal components; also depicted in operative conjunction with the CRT is the carousel-borne, CRT particle-purging system according to the invention.

With reference to FIG. 3, the components of the CRT 22 include a faceplate 38 having a skirt 40 and a funnel 42. As the CRT 22 is one that is in-process; that is, in a state in which it is being manufactured, its condition is such that a phosphor screen 44 has been deposited on the inner surface of the faceplate 38, a conductive coating 46 has been applied to the inner surface of the funnel 42, and a shadow mask 48 has been suspended adjacent to the faceplate 38 by three mounting springs, one spring 50 being indicated. At this stage of production, an electron gun has not yet been installed, and the neck 32 has an opening 52 for receiving the electron gun and an electrical socket, and for evacuating the envelope 34 in ensuing operations.

The conveyor-borne CRT particle-purging system 36 essentially comprises a vibratory platform 54 with an ultra-sonic vibrator 56 mounted thereon.

The means for releasably attaching the vibratory platform 54 in operative conjunction with the envelope 34 of the CRT 22 comprises vacuum cup means, which are shown in this example as consisting of two vacuum cups 58 and 60 which extend from the vibratory platform 54, and which are shown as gripping the skirt 40 of the CRT 22. The vibratory platform 54 and the means of its attachment to a CRT envelope is designed for releasable attachment to all sizes of CRT envelopes of standard configuration. The air is drawn from the vacuum cups 58 and 60 through a tube 90, with the withdrawal controlled by a valve 91. The means for the actuation of the valve 91 and other valves to be described is disclosed infra.

The tip 64 of the vibrator 56 is moved into contact with the glass of the skirt 40 by the collapse of the two vacuum cups 58 and 60, a movement indicated by arrow 65. The vacuum cups 58 and 60 are caused to collapse by exhausting air from them at a predetermined time. The tip 64 of the vibrator 56 is rounded to compensate for slight variations in the angle of attachment that may occur when the vibratory platform 54 is releasably attached to the envelope 34.

The conveyer-borne particle-purging system 36 according to the invention further includes a canister 30 installed over the neck 32. Particles within the envelope 34 of CRT 22 are dislodged by the pulsations of the vibrator 56 and are dispersed by pressurized air, causing them to fall into the canister 30. Pressurized air is conveyed to the canister 30 through pneumatic tubing 92 connected to a T-connection 94. A first leg 96 of the T-connection 94 provides pressurized air for retention of the canister 30 on the neck 32, and a second leg 100 provides pressurized air for purging the envelope.

Figure 3A:
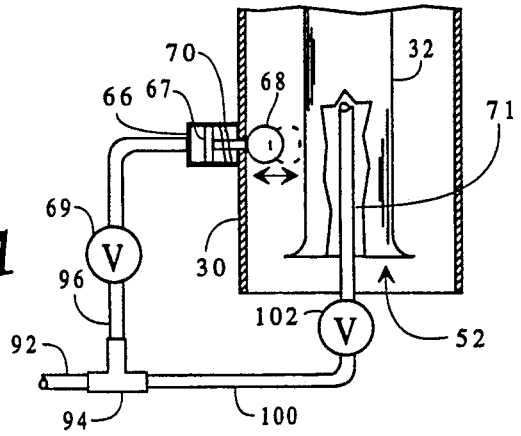
FIG. 3A is a cutaway view of a section of the neck of the CRT, showing details of a system for clamping a particle-catching canister over the neck, and supplying air for purging the CRT envelope of particles.

With reference to the detail view of FIG. 3A, the canister 30 is held on the neck 32 of the CRT 22 by the action of an air cylinder 66. The advancement of the piston 67 of the air cylinder 66 presses a resilient ball 68 against the neck 32. The back and forth movement of the resilient ball 68 is indicated by the dotted outline of the ball, and the associated arrow. The air cylinder 66 is activated and deactivated by a valve 69 in the tube 96 that supplies pressurized air to the air cylinder 66. A spring 70 within the air cylinder 66, by its pressure against the piston 67, causes the resilient ball 68 to retract and release the canister 30 from the neck 32 when the pressurized air feeding the air cylinder 66 is shut off and released from the air cylinder 66 by the closing of the valve 69.

Particle-purging is further assisted by dispersing pressurized air within the envelope 34 of the CRT 22. The pressurized air enters the canister 30 by way of the second leg 100 of T-connection 94. An extension 71 of the tubing of the second leg 100 passes through the neck 32 and into the funnel 42 where it is terminated by a perforated nozzle 72 (FIG. 3). The dispersion of pressurized air from the nozzle 72 is indicated by the arrows 73. Incorporated in the nozzle 72 is a pellet of radioactive material (not shown) which ionizes the passing air to neutralize and dislodge particles within the envelope 34 which carry an electrical charge. On-off control of the purging air is provided by a valve 102.

An inert gas such as dry nitrogen may be used in lieu of air. Air however, when dried and filtered, is the preferred medium as it is readily available and less costly.

The number and types of particles that fall into the canister 30 can be collected, monitored, and categorized among the particle types previously noted. The particles can be monitored by a particle monitoring means 74, indicated schematically as a block. The particle monitoring means 74 may comprise a Model 4100AT Particle Counter manufactured by Pacific Scientific of Silver Spring, Md.

It may be determined by the particle monitoring means 74 that a CRT has an out-of-limit number of particles of the same origin. For example, if the inner conductive coating 46 was improperly applied, the out-of-limit number and type of particles will be detected by the particle counter 74, and the CRT will be subject to rejection. If an improper condition is detected in a single CRT, all succeeding CRTs on the conveyor system may be monitored to determine whether an entire production lot is so affected.

Figure 1:
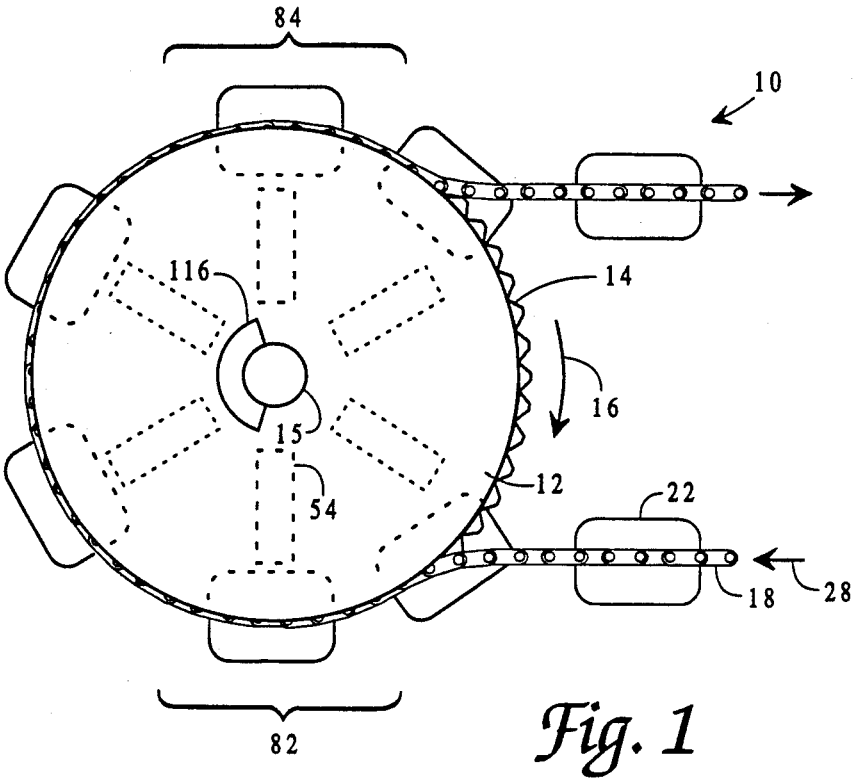
FIG. 1 is a top view of conveyor carousel carrying a CRT, and depicting the path of the CRT in its traverse.
Figure 2:
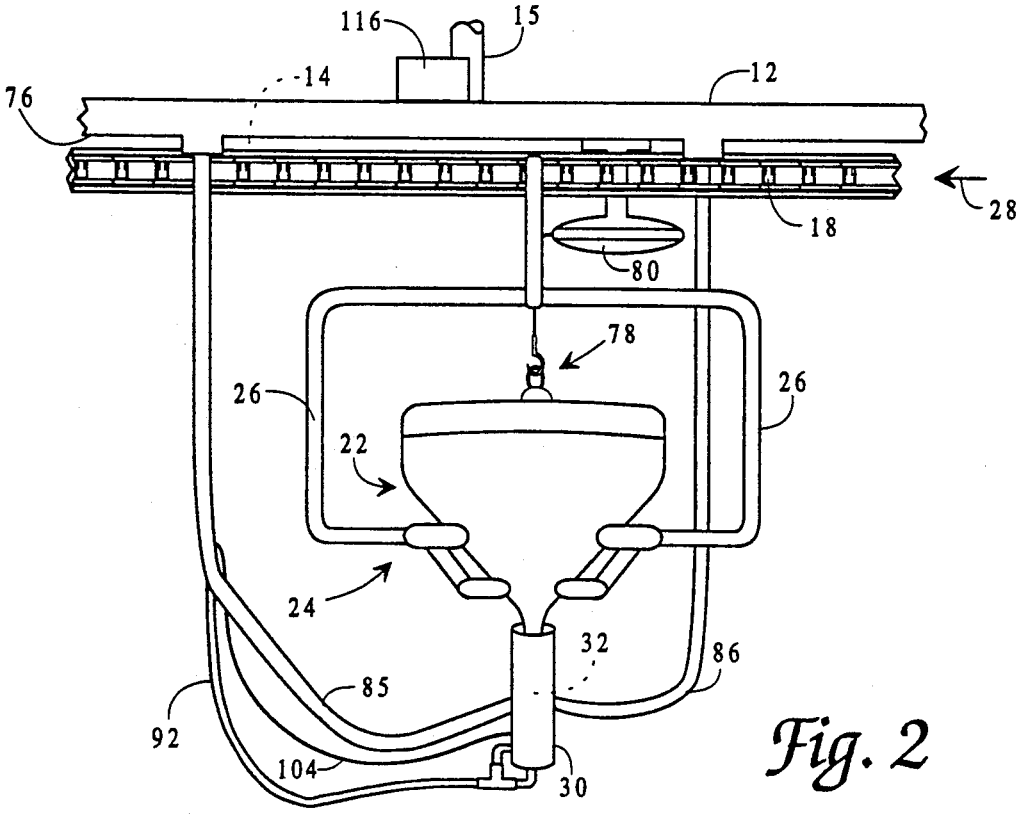
FIG. 2 is a side view of the CRT depicted in FIG. 1, showing how it is carried neck-side-down on the conveyor; also indicated are the electrical and pneumatic connections routed to the CRT through the carousel.

The path of the vibratory platform 54 around the carousel 12 in conjunction with the CRT 22, is depicted diagrammatically in FIG. 1. The vibratory platform 54 is suspended from the underside 76 of the carousel 12 by means of a three-axis positioning mechanism 78 (FIGS. 2 and 3) which provides for unimpeded movement of the vibratory platform 54, enabling the vibratory platform 54 to be releasably attached to the envelope 34 of the CRT 22. The weight of the vibratory platform 54 is offset by a spring-retraction windlass 80.

Additional vibratory platforms 54 (not indicated) may be suspended from the underside 76 of the carousel 12, providing for an uninterrupted cycling of the succession of CRTs conveyed to the carousel 12 by the conveyer roller chain 18. Additional vibratory platforms 54 will be required if the diameter of the carousel is greater than the carousel 12 described; that is, greater than fourteen feet.

Figure 4:
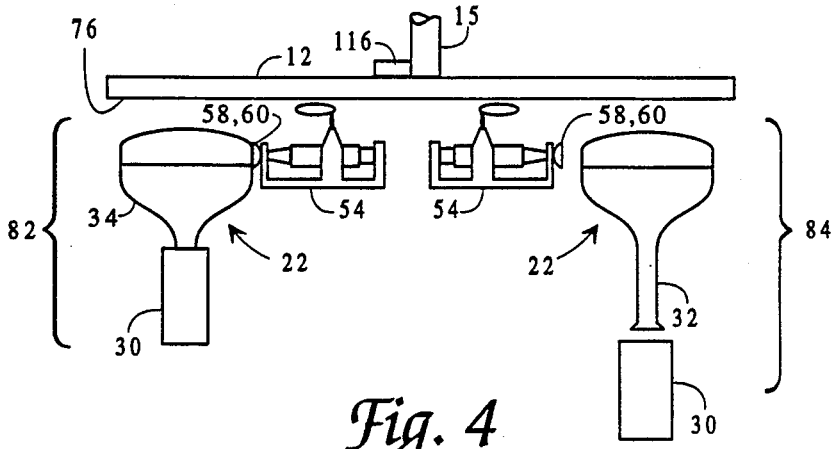
FIG. 4 is a view in elevation that depicts the releasable attachment of a carousel-borne particle-purging system to a CRT at coupling and uncoupling stations.

With reference also to FIG. 4, the vibratory platform 54 is installed in operative conjunction with the envelope 34 of the CRT 22 at a coupling station 82. The coupling of the vibratory platform 54 to the envelope 34 is accomplished manually by swinging the vibratory platform 54 into propinquity with the envelope 34 so that the vacuum cups 58 and 60 make contact with the envelope 34. As the vacuum cups 58 and 60 come into contact with the envelope 34, air is exhausted from them, and the vacuum cups 58 and 60 releasably attach the vibratory platform 54 to the envelope 32.

The canister 30 is installed over the neck manually at coupling station 82. The two operations—coupling of the vibratory platform 54 to the CRT envelope, and installation of the canister 30—could as well be accomplished entirely automatically by means known to those skilled in the mechanical art.

The CRT 22, with the vibratory platform 54 coupled to the envelope 34, and with the canister 30 installed, is then carried by the conveyor roller chain 18 in the circular path indicated by arrow 16 (FIG. 1). The CRT 22 and the conjoined vibratory platform 54 are carried by the carousel 12 to the uncoupling station 84 (FIG. 4), where the vibratory platform 54 is released from the envelope 34 by the release of the vacuum cups 58 and 60, and action initiated by a time and position controlling device described in following paragraphs.

At the same time, the canister 30 drops away from the neck 32 at the uncoupling station 84. Two elastic bungee cords 85 and 86 (FIG. 2) hang from the underside 76 of the carousel 12, and are attached to the canister 30. When the canister 30 drops clear of the neck 32, the bungee cords 85 and 86 suspend the canister in place ready for installation over the neck of the CRT next in line on the conveyor.

Figure 5:
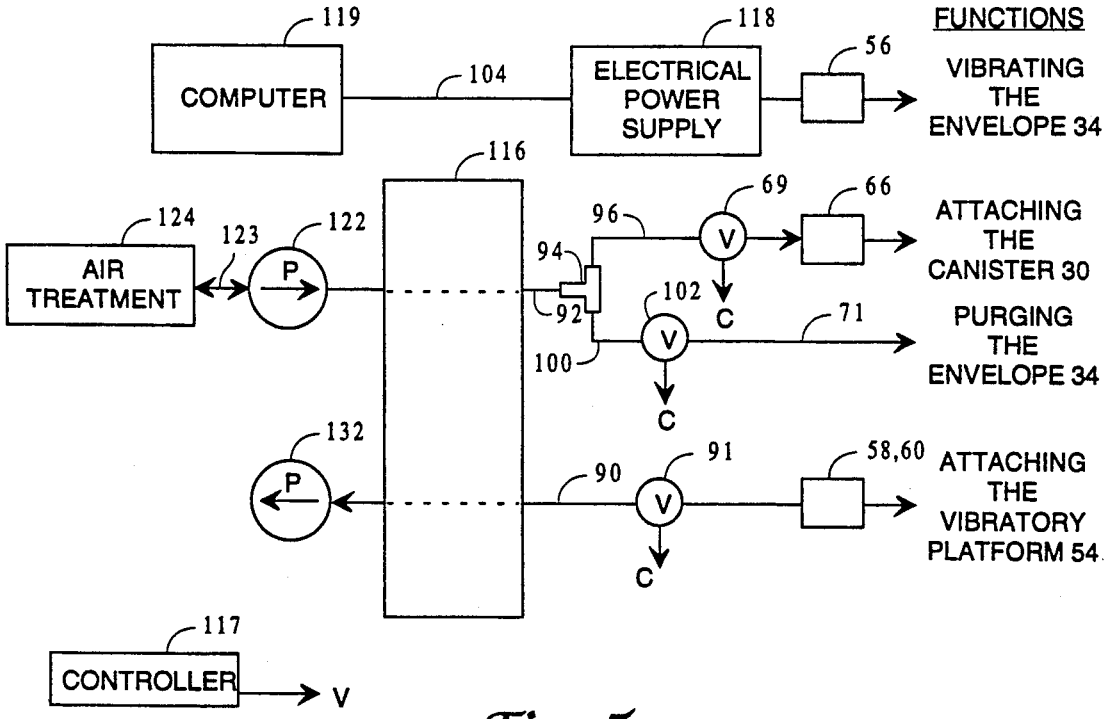
FIG. 5 is a schematic depiction of the routing of the electrical and pneumatic connections to and from the carousel-born particle-purging system according to the invention.

The carousel-borne, CRT particle-purging system according to the invention is activated by electrical and pneumatic means routed to the major components by electrical wires and pneumatic tubing, depicted schematically in FIG. 5. The pneumatic path may be by way of combined pneumatic and electrical commutator 116 which is linked to shaft 15 on which carousel 12 rotates. The pneumatic valves, designated "V", can be activated by an electromagnetic controller 117 such as a drum programmer. Elements of a mechanical drum programmer could as well be incorporated in the commutator 116. In lieu of a drum programmer, control of all functions can be accomplished by computer means. The valves "V" are preferably air-control solenoid valves designed for the ON-OFF control of pressure and vacuum lines. Certain of the valves are of the "bleeder" type; that is, they bleed the pressure from the component when they are closed, causing the component to revert to a standby condition.

The programming of the controller 117 is based on the time required for the CRT 22 to travel from the coupling station 82 to the uncoupling station 84. The duration of travel may be one minute, depending on the diameter of the carousel and the speed of the conveyor roller chain 18.

The vibratory platform 54 is attached to the envelope 34 of the CRT 22 by drawing air from the vacuum cups 58 and 60 by means of a vacuum pump 132. The route of the low pressure of the vacuum pump 132 is by way of commutator 116, tubing 90, and air-control valve 91. The vacuum cups 58 and 60 grip the envelope 34, causing the tip 64 of the vibrator 56 to move into operative contact with the CRT envelope 34. The air-control valve 91 is opened at the coupling station 82 to exhaust air from the vacuum cups 58 and 60.

At the uncoupling station 84, the valve 91 is closed by the controller 117, and air is bled from the vacuum cups 58 and 60, releasing the vibratory platform 54 from the CRT envelope 34.

Vibrating the envelope 34 is accomplished as follows: Power for operation of the vibrator 56 is provided by an electrical power supply 118. A computer 119, connected to the electrical power supply 118 by a conductor 104, and synchronized with the rotation of the carousel 12, controls the output of the electrical power supply 118, switching the vibrator 56 on and off. Vibration is preferably provided for a period of thirty to forty seconds as the vibratory platform 54 traverses around the carousel 1 in conjunction with the CRT 22.

The vibrator 56 is preferably a one kilowatt, twenty kiloHertz ultrasonic vibrator operating at a frequency of about 20 kiloHertz. It is amplitude modulated from zero to maximum. The vibrator 56 essentially comprises a tuned ultrasound horn driven by an electrical transducer. A suitable vibrator complete with an electrical power supply is the Model No. 905 manufactured by the Branson Company of Danbury, Conn.

Pressurized air supplied by a pneumatic pump 122 activates the air cylinder 66 which attaches and releases the canister 30 with respect to the neck 32, and purges particles from within the CRT envelope 34. The input 123 of the pneumatic pump 122 is connected to an air-treatment stage 124 in which the air is dried and filtered. The pressurized air from the pump 122 is routed through the commutator 116, and through pneumatic tubing 92 to T-connection 94.

The first leg 96 of the T-connection 94 connects with the pneumatic valve 69 which controls the introduction and the release of pressurized air into the air cylinder 66. A lever-actuated electronic switch (not indicated), may be used to sense the insertion of the neck 32 into the canister 30, and actuate the valve 69. When the canister 30 is slipped over the neck 32 of the CRT 22, valve 69 is opened, and the piston 67 of the air cylinder 66 presses the resilient ball 68 against the neck 32. As a result, the canister 30 is retained on the neck 32 as the CRT 22 traverses around the carousel 12.

At the uncoupling station 84, the valve 69, actuated by controller 117, closes and bleeds air from the the air cylinder 66. The piston 67 is forced back by the spring 70, causing the resilient ball 6 to retract from contact with the neck 32. The canister 30 then falls away from the neck 32.

Purging the envelope 34 is accomplished by the introduction of pressurized air from the pneumatic pump 122 into the envelope 34 through tubing 71, which comprises an extension of the second leg 100 of the T-connection 94. The air-purging valve 102 is opened and closed by controller 117 to provide, by way of example, a five-second air purging of the CRT envelope 34.

While a particular embodiment of the invention has been shown and described, it will be readily apparent to those skilled in the art that changes and modifications may be made in the inventive means and method without departing from the invention in its broader aspects. Therefore, the aim of the appended claims is to cover all such changes and modifications as fall within the true spirit and scope of the invention.

We claim:

1. A carousel-borne CRT particle-purging system for dislodging particles from within the envelope of a CRT carried on a conveyer, comprising:

a) a vibrator for imparting vibration to the envelope;

b) releasable attachment means for releasably attaching the vibrator to the envelope; and c) means for traversing the vibrator on the conveyor in operative conjunction with the envelope.

2. The carousel-borne CRT particle-purging system of claim 1 wherein the releasable attachment means comprises vacuum cup means.

3. The carousel-borne CRT particle-purging system of claim 1 wherein the vibrator is an ultrasonic vibrator.

4. A carousel-borne CRT particle-purging system for dislodging particles from within the envelope of an in-process CRT having an open neck, and carried neck-side-down on a conveyer, comprising:

a) a vibratory platform including:

1) a platform 2) a discrete vibrator extending from the platform;

b) means for suspending the vibratory platform from the carousel;

c) means for releasably attaching the vibratory platform to the envelope;

d) means for moving the vibrator into contact with the envelope; and e) power supply means for energizing the vibrator;

whereby particles dislodged by the vibration fall into the neck.

5. The carousel-borne CRT particle-purging system of claim 4 wherein the vibrator is an ultrasonic vibrator.

6. The carousel-borne CRT particle-purging system of claim 4 wherein the means for releasably attaching the vibratory platform to the envelope comprise vacuum cup means.

7. The CRT particle-purging system according to claim 4 further including a canister installed over the neck for receiving particles falling out of the neck.

8. A method for dislodging particles from within the envelope of an in-process CRT having an open neck and carried neck-side-down on a conveyor, comprising:

a) suspending vibratory means from the carousel;

b) releasably attaching the vibratory means in operative conjunction with the envelope;

c) activating the vibratory means;

d) releasing the vibratory means from the envelope;

whereby particles within the envelope are dislodged by the vibrator and fall out of the neck.

9. The method of claim 8 further including mounting the vibratory means on a vibratory platform.

10. The method of claim 8 further including the step of releasably attaching the vibratory platform to the envelope by vacuum cup means.

11. The method of claim 8 further including the step of supplying the vibrator in the form of an ultrasonic vibrator.

12. The method of claim 8 further including installing a canister over the neck for catching the particles.

13. A method for dislodging particles from within the envelope of an in-process CRT having an open neck and carried on a conveyor, comprising:

a) installing a canister over the neck;

b) releasably attaching to the envelope a vibratory platform having a vibrator extending therefrom;

c) contacting the envelope with the vibrator;

d) vibrating the envelope to dislodge the particles into the canister;

e) detaching the vibratory platform from the envelope;

f) removing the canister;

whereby particles dislodged by the vibrator fall out of the neck and into the canister.

14. The method of claim 13 including vibrating the envelope with an ultrasonic vibrator.

15. The method of claim 13 including the step of releasably attaching the vibratory platform to the envelope by vacuum cup means.

* * * * *